United States Patent [19]

Asmus

[11] 3,981,412

[45] Sept. 21, 1976

[54] CONTAINER CLOSURE

[76] Inventor: Richard W. Asmus, 3628 W. 48th St., Cleveland, Ohio 44102

[22] Filed: Mar. 29, 1971

[21] Appl. No.: 128,804

[52] U.S. Cl. ..... 220/270; 215/16; 215/252; 215/256; 220/258; 220/276

[51] Int. Cl.[2] ..... B65D 17/20

[58] Field of Search ..... 220/54, 27, 270, 276, 220/258; 215/42, 46 A, 1 C, 252, 255; 206/DIG. 34

[56] References Cited

UNITED STATES PATENTS

| | | | |
|---|---|---|---|
| 3,281,007 | 10/1966 | Dorosz | 220/54 |
| 3,407,957 | 10/1968 | Robinson | 215/42 |
| 3,415,412 | 12/1968 | Robinson et al. | 220/54 |
| 3,426,102 | 2/1969 | Solak et al. | 206/DIG. 34 |
| 3,499,572 | 3/1970 | Ruekberg | 220/54 |
| 3,532,248 | 10/1970 | Ruekberg | 220/54 |
| 3,671,607 | 6/1972 | Lee | 215/1 C |

*Primary Examiner*—William Price
*Assistant Examiner*—Stephen Marcus
*Attorney, Agent, or Firm*—Albert L. Ely, Jr.

[57] ABSTRACT

Disposable container closures of low gas and vapor permeability, high-impact resistant, cleanly combustible thermoplastics fusable to the rim of container openings to seal the same but readily manually opened by integral tab positioned to commence tears along score lines promoting and utilizing the unexpected relatively low resistance of the otherwise tough materials to continued tearing once a tear is started.

9 Claims, 12 Drawing Figures

INVENTOR.
RICHARD W. ASMUS
BY
ELY, GOLRICK & FLYNN
ATTORNEYS

INVENTOR.
RICHARD W. ASMUS
BY
ELY, GOLRICK & FLYNN
ATTORNEYS

CONTAINER CLOSURE

This invention relates to an improvement in disposable closures for containers and, more particularly, to container closures formed from high-impact resistant combustible thermoplastics having low gas and vapor permeability which may be fused to the openings of the containers to effectively seal the same but which are readily manually opened.

Heretofore, containers of glass and metal have continued to be required for packaging nearly all unfrozen foods and beverages, particularly carbonated soft drinks and beer, due to the inherent physical strength of these conventional materials, their inertness to components of the contents, and their high degree of imperviousness to gases and vapors.

Such inertness to any significant degree of chemical reaction or solubility between the contents and the containers over and beyond avoidance of leakage, is essential to preserve the fitness for consumption during an adequate shelf-life and also to protect the appearance, taste, and odor of the packaged contents. Particularly for the latter requisites, mere inertness of the internal container surface is not enough; until recently only glass or metal (properly coated or plated, if necessary) possessed the necessary imperviousness to water and other vapors and gases, particularly oxygen and other atmospheric gases which, if transmitted through the container, could attack the contents; in the case of beer and carbonated soft drinks, retention of carbon dioxide under substantial super-atmospheric pressure is essential, since its loss would destroy the taste of the contents. Another requisite which confined the use of substitute materials, such as plastics, to containers largely for non-food products or those which require no preservation as such was the need for resistance to the high temperatures needed for sterilizing the containers prior to packaging or for processing them afterward; also metal and glass containers could be fabricated to have sufficient toughness to provide the impact resistance requisite for shipping and handling.

The very physical characteristics, as outlined above, which made metal and glass suitable materials for containers has presented increasingly serious ecological problems in disposing of them after use. Many available plastics which offered some promise of providing these physical characteristics, such as the halogenated vinyls and polyolefins, posed equally serious disposal problems; they were generally as resistant to oxidation or reprocessing as metals and glass if not more so, and were not only resistant to incineration but emitted noxious and corrosive fumes and odors when degraded at high temperatures.

A particularly promising development in recent plastic technology for the container industry has been the development of non-halogenated thermoplastics, particularly acrylonitrile copolymers of high nitrile content and, to a degree, bi-axially oriented polypropylene, which have the requisite physical characteristics including very low permeability to atmospheric vapors and gases, insolubility to most liquids, physical stability at food processing temperatures, and high impact strength and toughness, the latter characteristic making them preferable to glass for packaging many products in addition to food products. Being thermoplastic, they are readily formed by standard forming techniques and, ecologically, they are much superior to metals and glass, since they are ignitable and burn cleanly at high temperatures and, thus, may be completely incinerated without atmospheric pollution or corrosion of metals in the incinerating equipment.

One serious problem common to all containers, including those of the above thermoplastics has been that of providing adequate and effective closures which, on the one hand, will thoroughly seal the containers and their contents and yet which can be readily opened manually without need for opening tools or equipment. Indeed, because of this closure problem, the above thermoplastics have been proposed primarily for use as narrownecked bottles for liquids which can be closed by the conventional screw-tops and crimped down closures, which also pose the same problem of disposal as the container of metal, glass, and plastic.

It is an object and advantage of this invention that it provides a readily manually opened but thoroughly sealed closure for containers of all types, but particularly for the above high-impact, low permeability thermoplastics. Such closures also enable cans as well as narrow-necked bottles to be made of such thermoplastics and being made of the same thermoplastics, closures according to this invention are also readily and cleanly disposable by incineration.

Other objects and advantages of this invention will be apparent from the following specification, claim, and drawings, in which:

Figure 1:
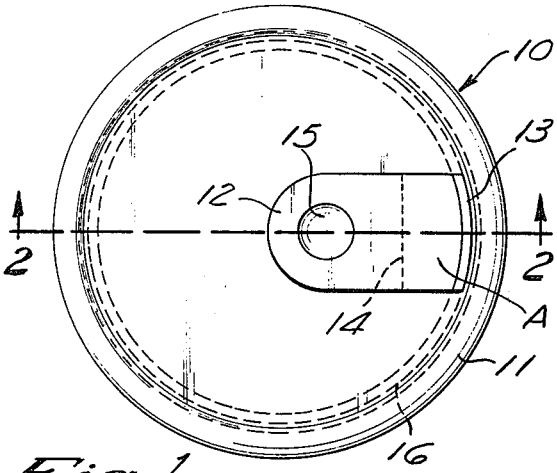
FIG. 1 is a top plan view of an all-plastic can sealed with an end closure made according to this invention.

Referring to FIG. 1, a can top 10 comprises a disc or tough, high-impact strength thermoplastic of low permeability to gases and vapors and possessing adequate mechanical strength and inertness. A suitable thermoplastic for the top 10 is "Barex 210" (Vistron Corporation) a nitrile rubber-modified acrylonitrile methyl acrylate basic copolymer essentially consisting of a graft polymerization of acrylonitrile and methyl acrylate in the presence of a butadiene-acrylonitrile copolymer. Another suitable thermoplastic for the top is "Barex 410" (Vistron Corporation), a nitrile rubber-modified copolymer of methacrylonitrile-methyl methacrylate. Still another suitable thermoplastic, particularly if graft-polymerized to a butadiene-containing rubber base is Lopac 110 (Monsanto Corporation), a methacrylonitrile-styrene copolymer. These thermoplastics exhibit high barrier characteristic with respect to atmospheric gases and vapors. The ability of containers of such thermoplastics to withstand processing temperatures will vary according to the particular material employed. All will at least withstand temperatures is the order of 150°–185° for pre-pasturization (not under pressure) prior to filling under sterile conditions with sterile, pasturized, or otherwise preserve food and beverages at lower temperatures. Some, e.g., Barex 410, will withstand pasturization temperatures of 185° F. under pressure and will take sterilization temperatures (not under pressure) in the order of 210°–220°F. and may be filled with hot sterilized contents prior to closing. The manufactures of these thermoplastics produce them in grades having extremely colorless clarity, although, for many light-sensitive products, pigmented grades may be desirable. Another thermoplastic having high impact strength and able to withstand sterilization temperatures up to 220° for food packaging is biaxially oriented polypropylene (such as produced by the "Orbet" process of Phillips Petroleum Corporation); such orientation markedly increases stiffness and toughness, as compared with unoriented polypropylene and decreases the water vapor transmission by approximately 30%, oxygen permeation by approximately 50% and, thus, an improvement in resistance to $CO_2$ transmission in the order of 200%, conforming to the usual $Co_2$ transmission rate of 3 to 5 times that of the $O_2$ transmission rate of most thermoplastics (other than acrylic multipolymers and, of course, high nitrile acrylonitrile copolymers, in which the $CO_2$ transmission is even less than the $O_2$ transmission rate). Accordingly, while the resistance of such biaxially oriented polypropylene to transmission of $O_2$ and, particularly $CO_2$, is substantially less than that of high nitrile content acrylonitrile copolymers, its other physical properties, including its potential clean combustibility in the presence of sufficient oxygen, makes it satisfactory as a material for closures made according to this invention for packages of food and non-food products which do not require extreme protection from transmitted atmospheric vapors and gases.

Figure 2:
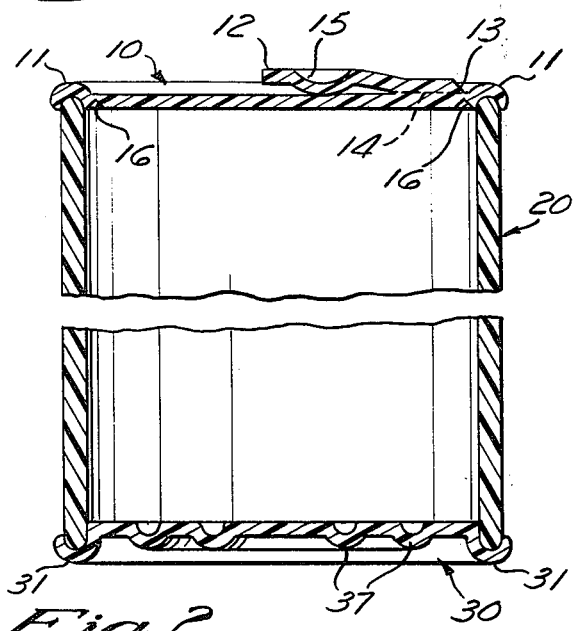
FIG. 2 is a vertical fragmentary cross-section, taken along the line 2—2 of FIG. 1.

As shown in FIGS. 1 and 2, the top 10 is provided with a circumferential bead 11 which provides, on its under surface a circumferential groove which both serves as a peripheral stiffening structure for the top 10 and receives the edge or rim of the opening of the container 20 to which the top 10 is united. As so joined to the container 20, the periphery of the top 10 becomes very rigid. An opening tab 12, preferably of the same flexible but otherwise relatively inelastic thermoplastic as the top 10, extends radially inwardly from the bead 11 and for a distance is integral with the top 10 in an area A defined by an arcuate groove 13 located just inside the bead 11 and a weld line 14. The balance of the tab 12 is separate from the upper surface of the top 10, being spaced therefrom by the downwardly extending dimple 15 formed in the free end of the tab 12 and serving to aid the gripping of the free end of the tab between the fingers.

The top 10 is provided with a tearing groove or score line 16. This may be on the upper surface but is preferably located just inside the bead 11 on its under surface so as to be congruent with the groove 13. By locating the tearing groove 16 on the under surface of the top 10, rather than on the upper surface, the accumulation of dust or soil in the groove during storage and handling is avoided. For the same reason, if any stiffening ribs are molded in the top 10, they are preferably located on its under surface.

The easy opening of the container 10 is accomplished by simply lifting the tab 12 so that it and the dimple 15 can be gripped between the thumb and forefinger and then giving a sharp tug diagonally upwardly and inwardly and preferably with a slight twist in either a clockwise or counterclockwise direction which is more or less instinctive with the most users. Despite the toughness and resistance of the preferred plastics to rupture and tear, it has been found that such material, once a tear has been started, has surprisingly low resistance to continued tear and, thus, a continued pull on the tab 12 will continue to tear the plastic in the locus of the root of the groove 13 at two moving points which follow the root of the groove away from the point of initial rupture in opposite clockwise and counterclockwise directions until they meet and the entire portion of the top 10 within the root of the groove can be lifted off the container to which it is secured. Despite the toughness and initial tear resistance of the plastic, apparently the relative stiffness of the top within the area A and in the bead 10 concentrates the force of a tug on the tab 12 at one corner of the area A at the locus of the roots of the concentric grooves 13 and 16 to effect a shearing or puncture which starts the subsequent easy continuous tear. Apparently the direction of the initial tug, though instinctive and natural, is significant in effecting the shear forces by which the initial puncture is obtained. Thus, there is a sharper notch which presumably would have a greater tendency to start a rupture at the weld line 14 but, instead of the tab 12 peeling away from the top 10 by rupture commencing at this line when it is pulled up and away from the top 10, the rupture will normally preferentially begin at the relatively thin section between the roots of the grooves 13 and 16.

The top 10 is preferably formed by cutting it as a blank from a sheet of the preferred plastic so as to leave a portion for the tab 12 attached to the blank, similar to the manner in which a closure blank with an attached tab may be blanked out of metal foil, as shown in R. W. Asmus and A. E. Jecker U.S. Pat. No. 3,501,045. The die with which the blank and attached tab is blanked out is preferably heated to form the dimple 15 in the tab 12, the bead 11, and the internal score line or groove 16. The tab 12 is then folded back against the top 14 and a hot die then welds the tab 12 to the top 10 in the area A while simultaneously formed the concentric groove 13 and pressure molding the folded-back portion of the tab 12 overlying the bead 11 so as to merge it into the contour of the bead. Alternatively, of course, the top 10 and the tab 12 may be separately formed and then fused together under heat and pressure in the area A.

As shown in FIG. 2, the container 20 is a can body comprising a length of extruded tubing of the same or compatible thermoplastic as the top 10 and closed at its other end by a bottom structure 30, also preferably of the same thermoplastic. The bottom structure 30, is provided with an internally grooved bead 31 similar to the bead 11 for joinder of the can wall and may be provided with stiffening ribs 37. As an alternative to the structure shown in FIG. 2, the container 20 may be initially formed as a unitary structure, as by blow-molding, and instead of being in the form of a can or wide-mouthed jar, the container may be in the form of a narrow-necked bottle. Where the container 20 is a narrow-necked jar, the proportional diameter of the closure 10 will be reduced to fit the mouth of the bottle while the size of the tab 12 will be maintained to enable it to be gripped for opening. If, by any forming process, the container 20 is of a unitary construction before application of the closure 10, the closure 10 is applied and sealed after the contents have been filled through the opening closed thereby. If the bottom structure of the container 20 is separately formed, the closure 10 is usually first applied and sealed, the contents are then filled through the inverted container, and the filled container is then closed by applying a bottom structure such as the hollow closure 30.

An advantage of making the top 10, the container 20, (and the bottom 30, if used) of the same or compatible thermoplastic is that the closures may be affixed to the rims of the openings of the container by fusion so as to thoroughly seal the contents until opened by the tab 12. Such fusion may be obtained by pressure under heated dies or other conventional means for effecting a fused joint between thermoplastics, including radio frequency and ultrasonic sealing means. A convenient sealing procedure may often be the "spin-welding" technique; by this technique a short burst of rapid relative movement under pressure between grooves of the bead 11 of the top 10 and mating rim of the opening of the container 20 generates, due to friction, sufficient heat at the interface to weld the surfaces together.

Figure 3:
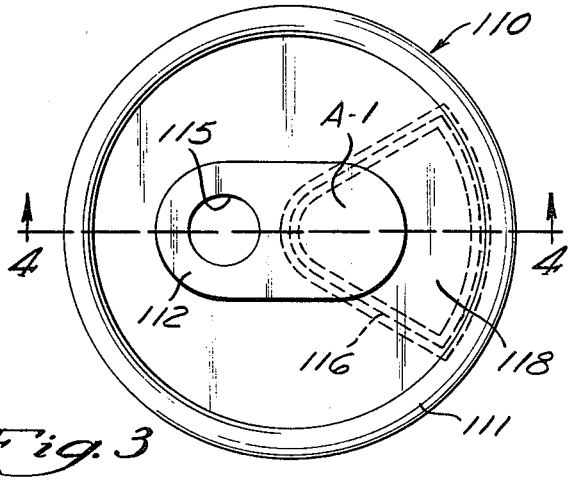
FIG. 3 is a plan view of a modification of a closure made according to this invention.
Figure 4:
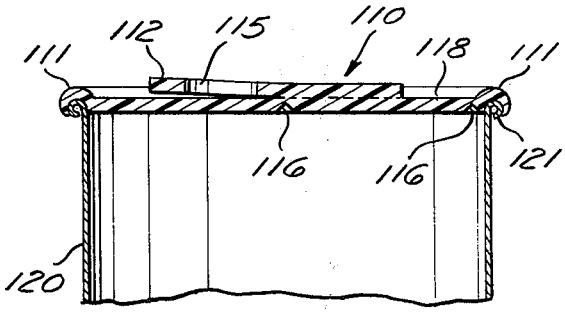
FIG. 4 is a fragmentary detail cross-section taken along the line 4—4 of FIG. 3 and showing the closure affixed, for example, to a conventional sheet metal can body.

FIGS. 3 and 4 show a modified top 110 of a closure made according to this invention where merely a pouring opening in the closure, rather than complete opening of the container mouth, is desired. As in the case of the top 10 of FIG. 1, the top 110 is formed of a tough, flexible, but otherwise inelastic thermoplastic having low transmission of atmospheric vapors and gases, such as Barex 210, Barex 410, Lopac 110, or if the contents permit, other thermoplastics, such as a biaxially oriented polypropylene. The top 110 is formed with a grooved bead 111 to fit the mouth of the container 120 to which it is secured, but instead of having a tearing groove molded around the entire periphery just inside the bead 111, the tearing groove 116 defines the segmental portion 118 of the top 110 to be removed to provide a pouring opening. An opening tab 112 of the same or compatible thermoplastic as the top 110 is separately formed and fused to unite it to the portion 118 within the area A-1 defined by the overlap of the tab 112 and the apex of the portion 118 to which it is united. The tab 112, in this instance is provided with a hole 115, rather than a dimple, to aid in gripping the tab. Due to the initial concentration of forces at the apex of the portion 118, a short sharp upward tug on the tab 112 will rupture the root of the tearing groove at that apex and a continued pull will then tear the top 110 at the root of the groove until the portion 118 may be removed.

Although it is usually preferable, due to the disposability of the entire container and the effective sealing of the top and container body which may be obtained by fusion, to make the top closure and container of the same or compatible thermoplastic, container closures made according to this invention may also be used to close containers of other conventional materials, such as sheet metal, glass or spirally wound paper, or like container bodies. FIG. 4 shows in section a conventional sheet metal can body 120 formed with the flanged rim 121 conventionally provided for a crimped connection to a sheet metal can top. By first coating the rim 121 with a suitable sealant or adhesion promoter, such as an epoxy resin, rubber latex, or polyvinylchloride organisol or plastisol modified for compatibility with the thermoplastic of a closure made according to this invention, an effective seal by fusion may be obtained between the rim 121 and the bead 111.

Figure 5:
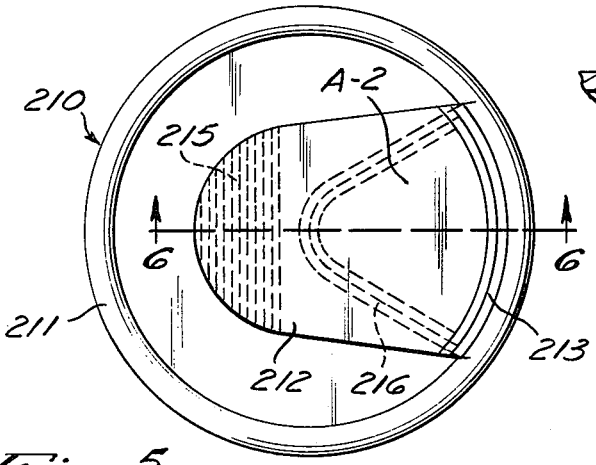
FIG. 5 is a plan view of another modification of a closure made according to this invention.
Figure 6:
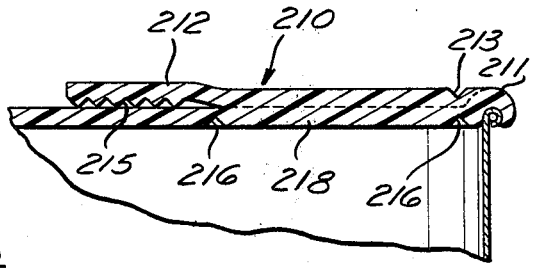
FIG. 6 is fragmentary detail cross-section taken along the line 6—6 of FIG. 5.

FIGS. 5 and 6 show a modification of a container top 210 similar to that shown in FIG. 3 except that the top is blanked out with its tab 212 from a sheet of the thermoplastic, the tab 212 then being folded back on the top 210 and fused thereto in the area A-2 defined by the overlap of the tab and a removable portion 218 defined by a tear groove 216 formed in the top 210. In order that the portion 218 may be completely removed with the tab 212 to provide a pour opening, a groove 213, corresponding to the groove 13 shown in FIG. 1, is formed adjacent the bead 211 at the time of fusion of the tab 212 to the portion 218. In lieu of the dimple 15 or hole 115 shown in FIGS. 1 and 3, serrations 215 may be formed in the tab 212 to aid in gripping it.

Figure 7:
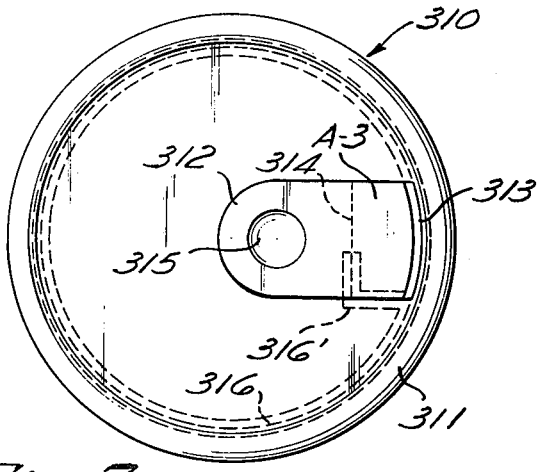
FIG. 7 is a view similar to FIG. 1 but showing one modification in the score line therefor.

FIG. 7 shows a variation of a can, jar, or bottle top 310 similar to the top 10 shown in FIG. 1, but modified to increase the ease of opening or to allow a shallower and smaller tear groove and, thus, a greater depth of section at the root of the tear groove; this latter minimizes the chance of accidental rupture of the top at the tear groove during handling and also decreases transmission of vapors and gases through the thinner section of the top at the root of the tear groove. As shown in FIG. 7, the top 310 is formed similarly to the top 10, with a bead 311, tab 312, external groove 313 and peripheral tear groove 316 corresponding to the like elements in the embodiment shown in FIG. 1. The tab 312, formed with a grip-improving means, such as the dimple 315 in this instance, is also fused so as to be integral with the top 310 in the area A-3 beneath the portion of the tab 312 between the groove 313 and weld line 314. The peripheral tear groove or score line 316, however, is provided with an inward extension 316' underlying a radial edge of the area A-3 and terminating with a short hook portion underlying the weld line 314. Since it is instinctive for most users in lifting and pulling the tab 312 to give it a twist in a counterclockwise direction, as shown by the direction arrow, the tear groove extension 316' is preferably located at the left hand side of the area A-3, as shown in FIG. 7 so that the initial rupture will begin at the inner corner of the area. Once the initial rupture is made, a continued pull on the tab 312 will cause the tear to extend to the peripheral tear groove 316 and thence around the periphery of the top 310 until its entire area inside the bead 311 may be removed.

Figure 8:
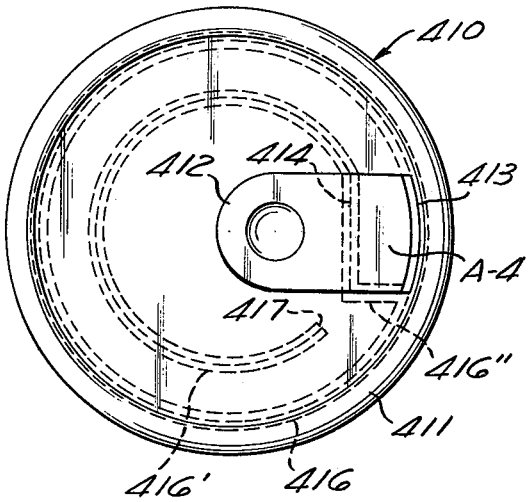
FIG. 8 is a view similar to FIGS. 1 and 7, but showing a further modification of score lines therefor.

If the gauge of a top closure made according to this invention is heavy, the inherent stiffness of the thermoplastic may make it awkward to flex the top sufficiently, when gripped by the opening tab alone, to continue the tear along a single peripheral tear or score line. In such cases, the modification shown in FIG. 8 may be employed. As there shown, the top 410 of the desired thermoplastic is provided with a peripheral bead 411 separated by the arcuate groove 413 from the tab 412. The tab 412 is fused to be integral with the top 410 in the area A-4 beneath the portion of the tab 412 between the groove 413 and a weld line 414. In addition to a peripheral tear groove 416 corresponding to the grooves 16 and 316 shown in FIGS. 1 and 7, the top 410 is provided with a second tear groove 416' which lies under the weld line 414 and then extends concentrically with the tear groove 416 to a point 417 outside the area A-4. Because of the aforementioned tendency of users to impart a counterclockwise twist to the tab 412 when lifting and tugging it to open the top 410, the tear grooves 416 and 416' are connected by a tear groove 416'' underlying the lefthand edge of the area A-4, as seen in FIG. 8. When the top 410 is ruptured at the inner left-hand corner of the area A-4 by a lifting and twisting tug on the tab 412, a continued twisting pull will continue to tear simultaneously along the root of the groove 416' and down the groove 416'' to the groove 416 and thence along the roots of these grooves until the top is torn off along the entire periphery of the groove 416. The center portion of the top may then be lifted off in the form of a torn strip between the grooves 416 and 416' and a center portion joined thereto by an untorn portion between the point 417 and the area A-4.

Figure 9:
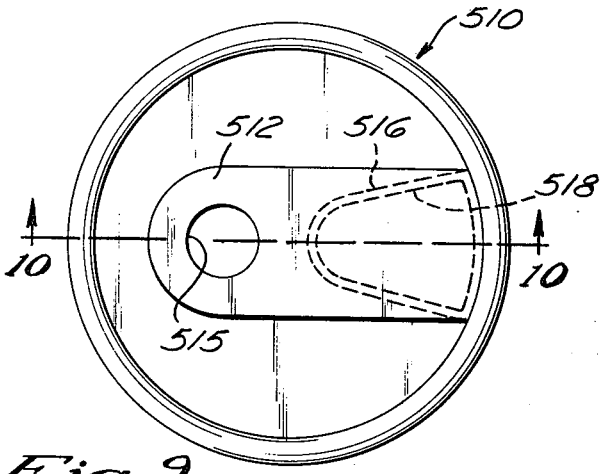
FIG. 9 is a plan view of another modification of a closure made according to this invention.
Figure 10:
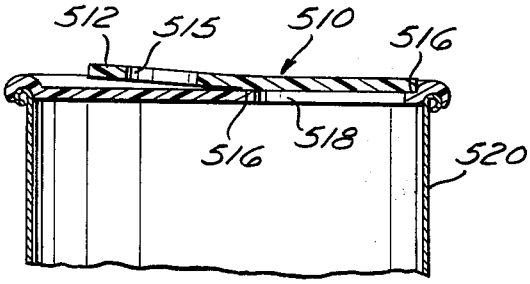
FIG. 10 is a cross-section along the line 10—10 of FIG. 9.

FIGS. 9 and 10 show a modification comprising a top 510 adapted to be fused to a container body 520 for packaging a liquid. Accordingly, the top 510 is provided with a punched pour-opening 518 sealed to the tab 512 which may be gripped by means of the hole 515. The tab 512 is sealed to the top 510 by a narrow line of fusion 516 (exaggerated in width in the drawings for purposes of illustration) extending around the periphery of the pour-opening 518. The section in shear along the line 516 being less than the gauge of the top 510 and tab 512, the container is readily opened by pulling on the tab 510 so as to rupture the seal along the line 516 and allow the liquid contents to be poured through the opening 518.

Figure 11:
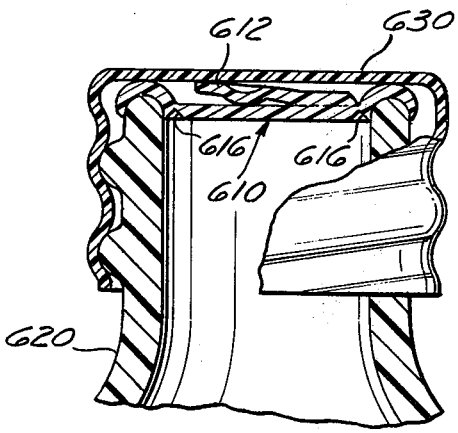
FIG. 11 is a showing, partly in elevation and partly in section, of a modification of a closure made according to this invention and showing its adaption to a closure for a container in the shape of a conventional narrow-mouthed bottle provided with a protective and reinforcing cover.
Figure 12:
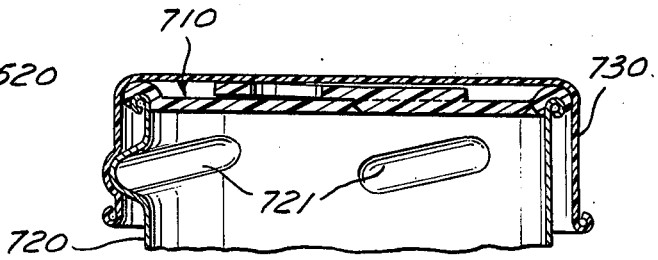
FIG. 12 is a cross-section showing a modification similar to that shown in FIGS. 3 and 4 but adapted to close a can provided with a protective and reinforcing cover.

FIG. 11 shows a conventional bottle-shaped container 620 sealed by thermoplastic closure 610 similar in structure to that of the closure 10 shown in FIG. 1 or 310 shown in FIG. 7 and having tab 612 corresponding to the tabs 12 or 312 permitting the closure 610 to be ruptured along the inner score line 616. For purposes of appearance as well as protection of the seal effected by the closure 610, and particularly for reinforcing purposes when thin film is used for the closure 610, a conventional threadedly secured auxiliary cap 630 is provided. As shown, the entire structure, container 620, closure 610, and protective cap 630, is formed of the preferred combustible thermoplastic. Where the contents must be filled and processed in the sealed container at sterilization temperatures in the order of 250°–310° F., it is usually preferable to make the container 620 of glass and the protective cap of metal, so as to mechanically support the thermoplastic closure 610 during such sterilization temperatures. An auxiliary cover may be desirable for the same purposes in widemouthed containers, such as shown in FIGS. 1 to 8. Thus, for example, FIG. 12 shows a container 720 similar to that of FIG. 4 except that interrupted threads 721 are formed in the container body to receive corresponding threads in a cover 730 for the closure 710. Whether of a preferred thermoplastic or of metal, glass, etc., such an auxiliary cover is printable with a suitable product indentification and the like; it can maintain the sealed closure in a sanitary condition until opened as well as reinforce the sealed closure, as hereafter set forth.

In most containers closed by closures according to this invention, the inherent stiffness of thermoplastics having the requisite imperviousness to atmospheric vapors and gases enables them to be made of a gauge which, on the one hand, allows them to be ruptured and opened by means of a pull tab as shown and, on the other, allows them to withstand, without reinforcement, substantial internal pressures such as are encountered in packaging carbonated soft drinks and beer and in storing them without cooling. Where such pressurized contents are likely to be stored at elevated temperatures or a reclosable package is desired, or where a thin gauge thermoplastic film is employed, one may employ a removable auxiliary cover secured by mating screw-threads or bayonet lugs formed in the walls of the container adjacent the opening sealed by a closure, similar to such a protective cover shown in FIGS. 6 and 7 of the said Asmus and Jecker U.S. Pat. No. 3,501,045. Since it is the sealed top, and not the protective auxiliary cover, which seals the contents of the container, the auxiliary cover will perform its function of mechancially protecting and reinforcing the sealed top without being so tightly secured to the container as to make the auxiliary cover difficult to remove manually. This invention, accordingly, is not limited to the specific embodiments disclosed but by the following claims.

What is claimed is:

1. A container comprised of a closure of cleanly combustible, high impact-resistant thermoplastic having low gas and vapor permeability and lower tear-resistance after rupture, said closure being united to the rim of the mouth of a container body, an opening tab having a free portion and a portion fused to said closure, said closure having a rupture line of lesser section defining the periphery of an opening therein, and said tab being positioned with respect to said line whereby the forces of a pull on the free portion of said tab concentrate at a rupturable portion of said rupture line and the continuation of a pull sufficient to effect initial rupture will continue to tear said closure along said line and allow said container to be opened.

2. A container as defined in claim 1 in which said line of rupture extends around the periphery of said closure within and adjacent the rim to which the closure is united.

3. A container as defined in claim 1 in which said rupture line defines a segment of the area of said closure and said tab is fused to said closure within said segmental area.

4. A container as defined in claim 1 in which said free end of said tab is provided with a surface discontinuity to aid the gripping of the tab.

5. A container as defined in claim 1 in which a segmental opening is punched in said closure, said opening being covered by said tab and the portion of said tab fused to said container constitues a line of fusion around the periphery of said opening to provide said rupture line.

6. A container as defined in claim 1 in which said line of rupture extends inwardly from said periphery to a point where said free porton of said tab is fused to said closure so as to locate the initially rupturable point in said rupture line.

7. A container as defined in claim 6 wherein a second rupture line starts at said point of initial rupture and extends therefrom concentrically with said first rupture line.

8. A container as defined in claim 1 including a protective cover over said closure and a depending flange thereon surrounding the rim of said container mouth and means formed in said flange and in the mouth portion of said container body to releasably connect said cover to said container body and allow said cover to reinforce closure.

9. A container as defined in claim 8 in which said connecting means is a threaded connection and the mouth portion of said container body is the neck of a bottle-shaped container body.

* * * * *